US005953766A

United States Patent [19]

Szoke

[11] Patent Number: 5,953,766

[45] Date of Patent: Sep. 21, 1999

[54] BIDET FOR A TOILET

[76] Inventor: Lajos Szoke, 260 Scarlett Road #1202, Toronto, Ontario, Canada, M6N 4X6

[21] Appl. No.: 09/121,329

[22] Filed: Jul. 23, 1998

[51] Int. Cl.[6] ..... A47K 3/20

[52] U.S. Cl. ..... 4/420.4; 4/443

[58] Field of Search ..... 4/420.4, 420.2, 4/420.5, 443, 447, 448, 420.1, 420, 420.3

[56] References Cited

U.S. PATENT DOCUMENTS

| | | | |
|---|---|---|---|
| 4,642,820 | 2/1987 | Boring, Jr. | 4/448 |
| 4,807,311 | 2/1989 | Ingels | 4/448 |
| 5,452,483 | 9/1995 | Dizon | 4/420.4 |

FOREIGN PATENT DOCUMENTS

| | | | |
|---|---|---|---|
| 2054298 | 4/1993 | Canada | 4/420.4 |

*Primary Examiner*—David J. Walczak

[57] ABSTRACT

A bidet for a toilet for enabling a toilet to be also used as a bidet. The bidet includes a mounting member securable to a base of a standard toilet through existing apertures used for securement of a toilet seat. A mixing valve is secured to an underside of the mounting member. The mixing valve having a pair of supply lines extending outwardly therefrom for coupling with existing hot and cold water lines. The mixing valve has a water outlet line extending outwardly thereof. The water outlet line extends along the mounting member and having a free end secured to a topside of the mounting member. A control handle is secured to the topside of the mounting member and extending into communication with the mixing valve to control the dispensing of water outwardly of the water outlet line. A spray head is positionable interiorly of the standard toilet. The spray head has a supply line extending outwardly therefrom. The supply line couples with the free end of the water outlet line of the mixing valve.

6 Claims, 2 Drawing Sheets

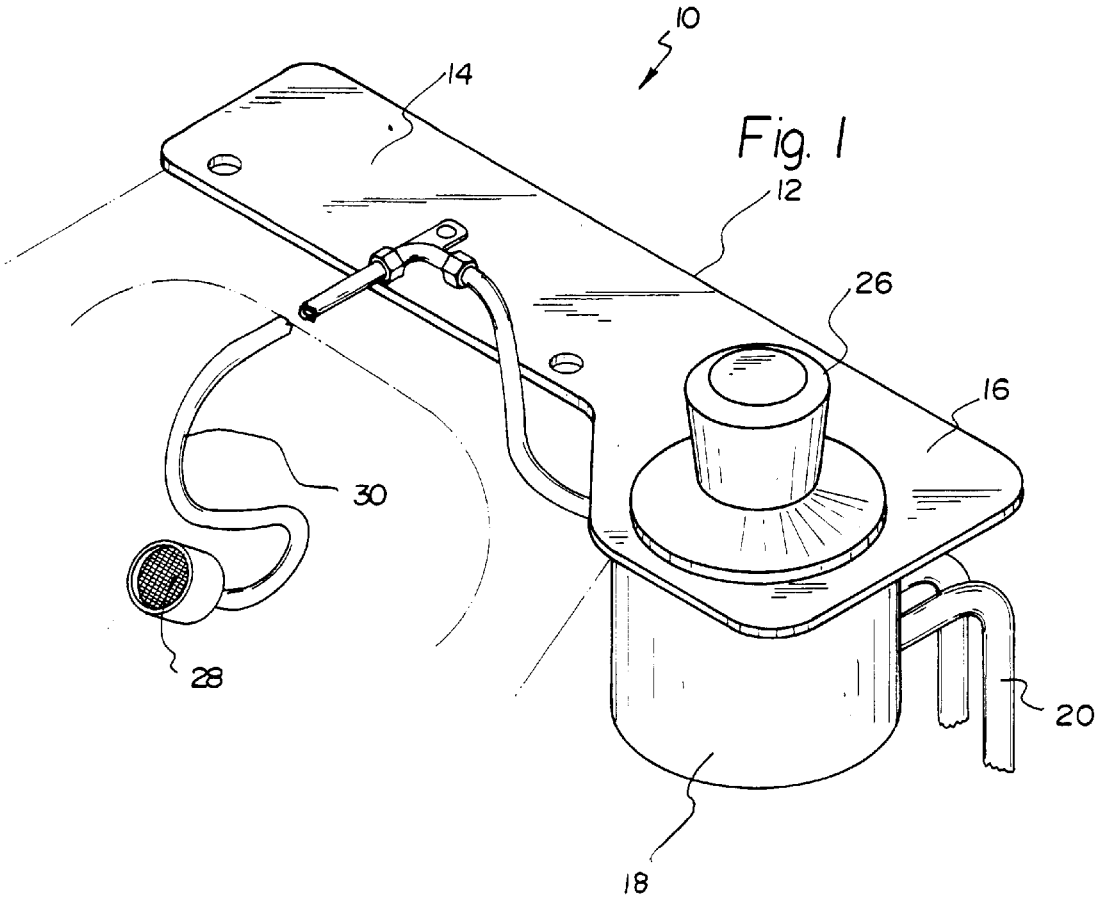
Fig. 1
Fig. 2
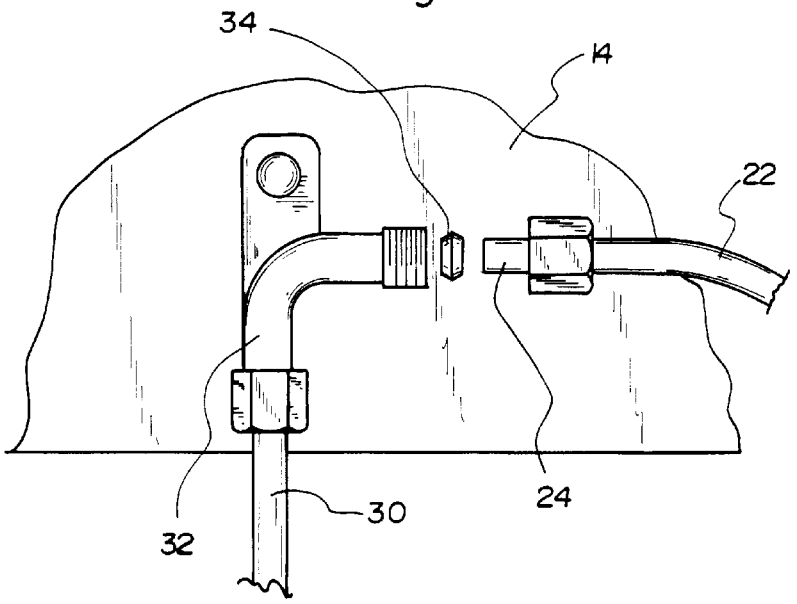

BIDET FOR A TOILET

BACKGROUND OF THE INVENTION

1. Field of the Invention

The present invention relates to bidets and more particularly pertains to a new bidet for a toilet for enabling a toilet to be also used as a bidet.

2. Description of the Prior Art

The use of bidets is known in the prior art. More specifically, bidets heretofore devised and utilized are known to consist basically of familiar, expected and obvious structural configurations, notwithstanding the myriad of designs encompassed by the crowded prior art which have been developed for the fulfillment of countless objectives and requirements.

Known prior art bidets include U.S. Pat. No. 5,090,067 to Cogdill; U.S. Pat. No. 4,259,754 to Bader et al.; U.S. Pat. No. 5,409,167 to Borod; U.S. Pat. No. Des. 341,877 to Drummond; U.S. Pat. No. 4,383,339 to Miller; and U.S. Pat. No. 4,622,704 to Chung.

While these devices fulfill their respective, particular objectives and requirements, the aforementioned patents do not disclose a new bidet for a toilet. The inventive device includes a mounting member securable to a base of a standard toilet through existing apertures used for securement of a toilet seat. A mixing valve is secured to an underside of the mounting member. The mixing valve having a pair of supply lines extending outwardly therefrom for coupling with existing hot and cold water lines. The mixing valve has a water outlet line extending outwardly thereof. The water outlet line extends along the mounting member and having a free end secured to a topside of the mounting member. A control handle is secured to the topside of the mounting member and extending into communication with the mixing valve to control the dispensing of water outwardly of the water outlet line. A spray head is positionable interiorly of the standard toilet. The spray head has a supply line extending outwardly therefrom. The supply line couples with the free end of the water outlet line of the mixing valve.

In these respects, the bidet for a toilet according to the present invention substantially departs from the conventional concepts and designs of the prior art, and in so doing provides an apparatus primarily developed for the purpose of enabling a toilet to be also used as a bidet.

SUMMARY OF THE INVENTION

In view of the foregoing disadvantages inherent in the known types of bidets now present in the prior art, the present invention provides a new bidet for a toilet construction wherein the same can be utilized for enabling a toilet to be also used as a bidet.

The general purpose of the present invention, which will be described subsequently in greater detail, is to provide a new bidet for a toilet apparatus and method which has many of the advantages of the bidets mentioned heretofore and many novel features that result in a new bidet for a toilet which is not anticipated, rendered obvious, suggested, or even implied by any of the prior art bidets, either alone or in any combination thereof.

To attain this, the present invention generally comprises a mounting member securable to a base of a standard toilet through existing apertures used for securement of a toilet seat. The mounting member has an essentially rectangular inner potion and an essentially square outer portion. The rectangular inner portion couples with the rim of the standard toilet. A mixing valve is secured to an underside of the outer portion of the mounting member. The mixing valve has a pair of supply lines extending outwardly therefrom for coupling with existing hot and cold water lines. The mixing valve has a water outlet line extending outwardly thereof. The water outlet line extends along the inner portion of the mounting member and has a free end secured to a topside of the inner portion. A control handle is secured to a topside of the outer portion of the mounting member and extends into communication with the mixing valve to control the dispensing of water outwardly of the water outlet line. A spray head is positionable interiorly of the standard toilet. The spray head has a supply line extending outwardly therefrom. The supply line couples with the free end of the water outlet line of the mixing valve.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bidet for a toilet apparatus and method which has many of the advantages of the bidets mentioned heretofore and many novel features that result in a new bidet for a toilet which is not anticipated, rendered obvious, suggested, or even implied by any of the prior art bidets, either alone or in any combination thereof.

It is another object of the present invention to provide a new bidet for a toilet which may be easily and efficiently manufactured and marketed.

It is a further object of the present invention to provide a new bidet for a toilet which is of a durable and reliable construction.

An even further object of the present invention is to provide a new bidet for a toilet which is susceptible of a low cost of manufacture with regard to both materials and labor, and which accordingly is then susceptible of low prices of sale to the consuming public, thereby making such bidet for a toilet economically available to the buying public.

Still yet another object of the present invention is to provide a new bidet for a toilet which provides in the apparatuses and methods of the prior art some of the advantages thereof, while simultaneously overcoming some of the disadvantages normally associated therewith.

Still another object of the present invention is to provide a new bidet for a toilet for enabling a toilet to be also used as a bidet.

Yet another object of the present invention is to provide a new bidet for a toilet which includes a mounting member securable to a base of a standard toilet through existing apertures used for securement of a toilet seat. A mixing valve is secured to an underside of the mounting member. The mixing valve having a pair of supply lines extending outwardly therefrom for coupling with existing hot and cold water lines. The mixing valve has a water outlet line extending outwardly thereof. The water outlet line extends along the mounting member and having a free end secured to a topside of the mounting member. A control handle is secured to the topside of the mounting member and extending into communication with the mixing valve to control the dispensing of water outwardly of the water outlet line. A spray head is positionable interiorly of the standard toilet. The spray head has a supply line extending outwardly therefrom. The supply line couples with the free end of the water outlet line of the mixing valve.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new bidet for a toilet according to the present invention.

FIG. 2 is a sectional top plan view of the present invention illustrating the coupling of the water outlet line to spray head supply line.

DESCRIPTION OF THE PREFERRED EMBODIMENT

Figure 3:
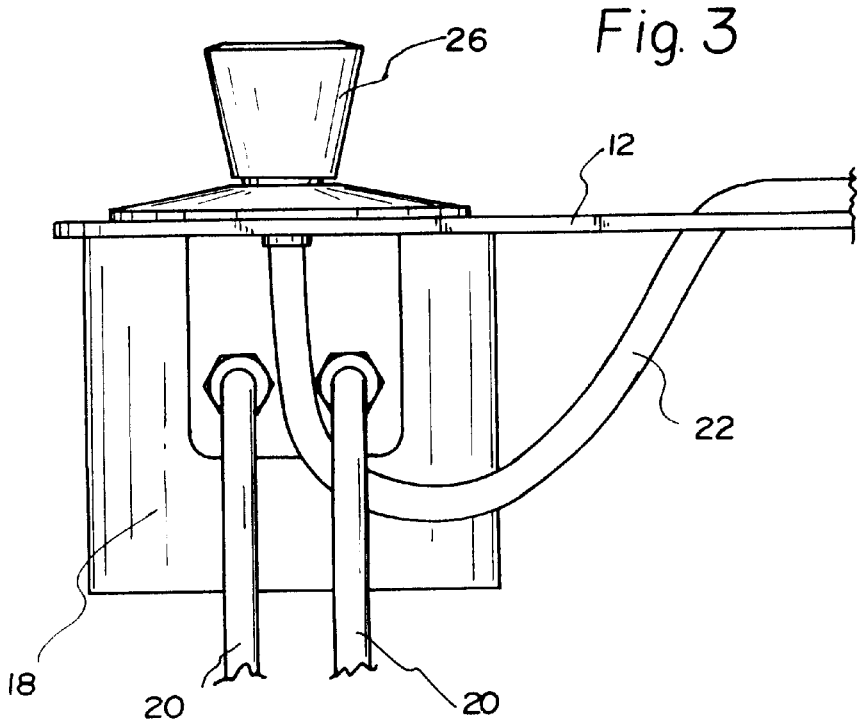
FIG. 3 is a rear elevation view of the present invention.
Figure 4:
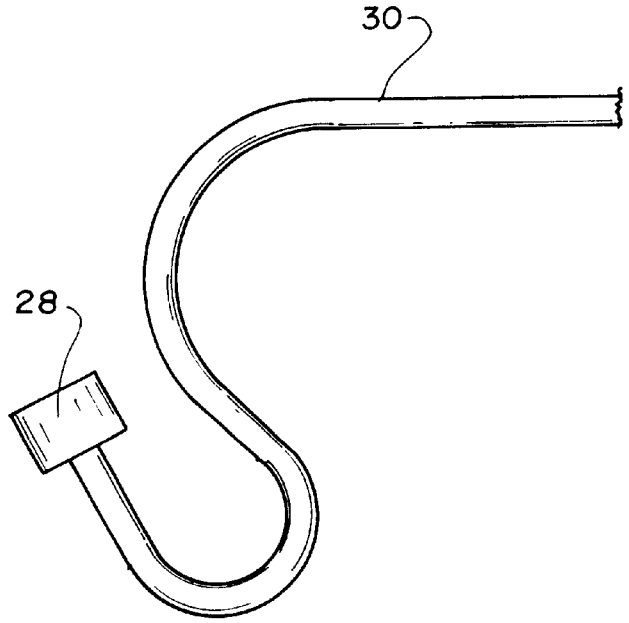
FIG. 4 is a side view of the spray head of the present invention.

With reference now to the drawings, and in particular to FIGS. 1 through 4 thereof, a new bidet for a toilet embodying the principles and concepts of the present invention and generally designated by the reference numeral 10 will be described.

As best illustrated in FIGS. 1 through 4, the bidet for a toilet 10 comprises a mounting member 12 securable to a base of a standard toilet at the existing apertures therein used for securement of a toilet seat. The mounting member 12 has an essentially rectangular inner potion 14 and an essentially square outer portion 16. The rectangular inner portion 14 couples with the rim of the standard toilet.

A mixing valve 18 is secured to an underside of the outer portion 16 of the mounting member 12. The mixing valve 18 has a pair of supply lines 20 extending outwardly therefrom for coupling with existing hot and cold water lines. The mixing valve 18 has a water outlet line 22 extending outwardly thereof. The water outlet line 22 extends along the inner portion 14 of the mounting member 12 and has a free end 24 secured to a topside of the inner portion 14. The mixing valve 18 would mix the hot and cold water therein to reach an ideal temperature.

A control handle 26 is secured to a topside of the outer portion 16 of the mounting member 12 and extends into communication with the mixing valve 18 to control the dispensing of water outwardly of the water outlet line 22.

A spray head 28 is positionable interiorly of the standard toilet. The spray head 28 has a supply line 30 extending outwardly therefrom. The supply line 30 couples with the free end 24 of the water outlet line 22 of the mixing valve 18. The supply line 30 is coupled to the free end via an L-shaped elbow tube 32 formed at a ninety degree angle. The tube 32 allows the supply line 30 to be reversed for use with both right and left-handed users. The free end 24 of the water outlet line 22 has a compression ring 34 disposed within the coupling with the L-shaped elbow tube 32. The supply line 30 is flexible to allow for the adjustment of the spray head 28 to the desired position for use.

Alternately, a stand-up version could be produced that will stand freely next to the toilet. Thus, the mixing valve 18 would be free-standing and only the water outlet line 22 and the spray head 28 would be secured to the toilet seat. The stand-up version would eliminate the need for the mounting member. The water outlet line 22 runs directly from the stand-up version of the mixing valve 18 to the toilet.

In use, the user would simply turn the control handle 26 to allow water to dispense outwardly of the water outlet line 22 through the spray head 28. The spray head 28 will spray the water on their private parts to effectively clean these areas.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bidet for a toilet for enabling a toilet to be also used as a bidet comprising, in combination:

a planar mounting member securable to a base of a toilet through existing apertures therethrough used for securement of a toilet seat, the mounting member having an essentially rectangular inner potion and an essentially square outer portion, the rectangular inner portion coupling adjacent a rim of the toilet bowl of the toilet;

a mixing valve secured to an underside of the outer portion of the mounting member, the mixing valve having a pair of supply lines extending outwardly therefrom for coupling with existing hot and cold water lines, the mixing valve having a water outlet line extending outwardly thereof, the water outlet line extending along the inner portion of the mounting member and having a free end secured to a topside of the inner portion;

a control handle secured to a topside of the outer portion of the mounting member and extending into communication with the mixing valve to control the dispensing of water outwardly of the water outlet line; and a generally S-shaped rigid supply line having opposite input and output ends, and upper and lower arcuate portions;

the supply line having a generally circular transverse cross section defining an outer diameter of the supply line;

a generally L-shaped elbow tube being coupled to the topside of the mounting member on the inner portion of the mounting member;

the elbow tube having a first end detachably coupled to the free end of the water outlet line and a second end detachably coupled to the input end of the supply line to fluidly connect the supply line to the water outlet line;

the first end of the elbow tube having a compression ring disposed therearound forming a seal between the first end of the elbow tube and the free end of the supply line;

the supply line being forwardly extended from the inner portion of the mounting member;

the upper arcuate portion of the supply line being positioned adjacent the input end of the supply line and the lower arcuate portion of the supply line;

the upper arcuate portion of the supply line having a rearwardly facing concavity and the lower arcuate portion of the supply line having a forwardly facing concavity;

the concavity of the upper arcuate portion of the supply line having a radius of curvature greater than that of the concavity of the lower arcuate portion;

the output end of the supply line facing upwardly from the lower arcuate portion of the supply line;

the supply line being adapted for extending into a toilet bowl of the toilet such that the output end of the supply line is positioned in the toilet bowl and faces upwards, the concavity of the upper arcuate portion being adapted for facing the rim of the toilet bowl;

a generally cylindrical spray head coupled to the output end of the supply line to fluidly connect the spray head to the supply line;

the spray head having a longitudinal axis coaxial with a center of the circular transverse cross section of the supply line at the output end of the supply line;

the spray head having an outer diameter defined perpendicular to the longitudinal axis of the spray head, the outer diameter of the spray head being greater than about twice the outer diameter of the supply line;

the spray head having a generally circular open upper end to permit passage of water therethrough out of the spray head;

the spray head being adapted for positioning in the toilet bowl such that the upper end of the spray head faces upwards.

2. A bidet for a toilet for enabling a toilet to be also used as a bidet comprising, in combination:

a planar mounting member securable to a base of a toilet through existing apertures used for securement of a toilet seat;

a mixing valve secured to an underside of the mounting member, the mixing valve having a pair of supply lines extending outwardly therefrom for coupling with existing hot and cold water lines, the mixing valve having a water outlet line extending outwardly thereof, the water outlet line extending along the mounting member and having a free end secured to a topside of the mounting member;

a control handle secured to the topside of the mounting member and extending into communication with the mixing valve to control the dispensing of water outwardly of the water outlet line; and a generally S-shaped rigid supply line having opposite input and output ends, and upper and lower arcuate portions;

the input end of the supply line being in fluid communication with the free end of the water outlet line;

the supply line being forwardly extended from the inner portion of the mounting member;

the upper arcuate portion of the supply line being positioned adjacent the input end of the supply line and the lower arcuate portion of the supply line;

the upper arcuate portion of the supply line having a rearwardly facing concavity and the lower arcuate portion of the supply line having a forwardly facing concavity;

the concavity of the upper arcuate portion of the supply line having a radius of curvature greater than that of the concavity of the lower arcuate portion;

the output end of the supply line facing upwardly from the lower arcuate portion of the supply line; and a spray head coupled to the output end of the supply line to fluidly connect the spray head to the supply line.

3. The bidet of claim 2, wherein the supply line has a generally circular transverse cross section defining an outer diameter of the supply line, wherein the spray head is generally cylindrical and has a longitudinal axis coaxial with a center of the circular transverse cross section of the supply line at the output end of the supply line.

4. The bidet of claim 3, wherein the spray head has an outer diameter defined perpendicular to the longitudinal axis of the spray head, wherein the outer diameter of the spray head being greater than about twice the outer diameter of the supply line.

5. The bidet of claim 2, further comprising a generally L-shaped elbow tube being coupled to the topside of the mounting member on the inner portion of the mounting member, wherein the elbow tube has a first end detachably coupled to the free end of the water outlet line and a second end detachably coupled to the input end of the supply line to fluidly connect the supply line to the water outlet line.

6. The bidet of claim 5, wherein the first end of the elbow tube has a compression ring disposed therearound forming a seal between the first end of the elbow tube and the free end of the supply line.

* * * * *